United States Patent [19]

Hager

[11] 4,088,085

[45] May 9, 1978

[54] SEWING DEVICE FOR PRODUCING FORM SEAMS

[75] Inventor: Walter Hager, Kaiserslautern, Germany

[73] Assignee: Pfaff Industriemaschinen GmbH, Germany

[21] Appl. No.: 764,814

[22] Filed: Feb. 2, 1977

[30] Foreign Application Priority Data

Feb. 20, 1976 Germany ..... 7605072[U]

[51] Int. Cl.[2] ..... D05B 21/00

[52] U.S. Cl. ..... 112/121.12; 112/203; 112/260; 112/121.15

[58] Field of Search ..... 112/121.11, 121.12, 112/121.15, 121.13, 121.25, 148, 265, 227, 260, 203, 204, 205, 215, 136, 148

[56] References Cited

U.S. PATENT DOCUMENTS

| | | | |
|---|---|---|---|
| 3,517,630 | 6/1970 | Bennison et al. | 112/121.12 |
| 3,814,038 | 6/1974 | Dorosz et al. | 112/121.15 |
| 3,983,825 | 10/1976 | Dobner et al. | 112/121.12 |

*Primary Examiner*—George H. Krizmanich
*Attorney, Agent, or Firm*—McGlew and Tuttle

[57] ABSTRACT

A sewing device for producing form seams is usable with a sewing machine having a needle which reiprocates in respect to a cooperating rotary hook. The sewing machine also includes a guide mechanism for guiding a workpiece along a path corresponding to the configuration of the form seam in respect to the needle. The device includes a workpiece support member having a stitch hole for the passage of the needle and a force-away surface bounding the stitch hole. The device includes a plate which is mounted so that the force-away surface is disposed between the needle and the rotary hook and it is mounted for vertical movement and horizontal oscillatory movement. The actuating means for the device causes a movement of the force-away surface in timed relationship to the reciprocation of the needle and in accordance with the movement of the workpiece in a direction opposite to the movement of the workpiece with respect to the needle and the rotary hook.

4 Claims, 3 Drawing Figures

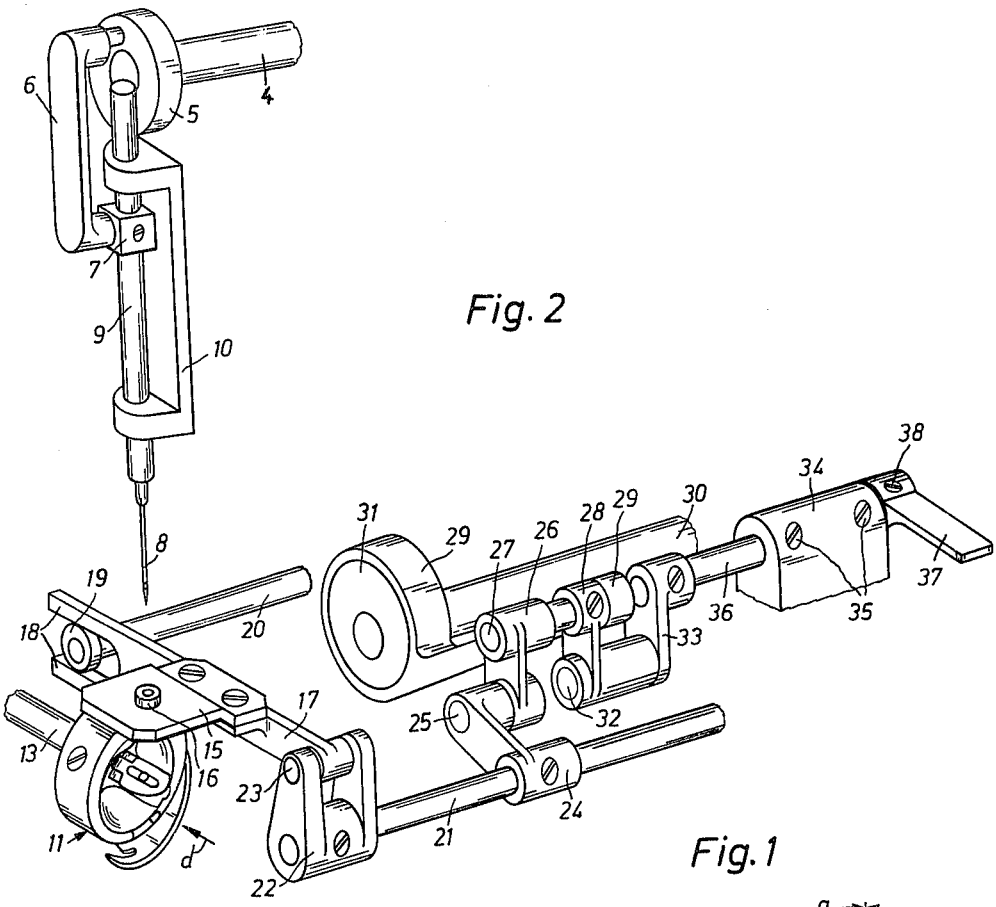
Fig. 2
Fig. 1
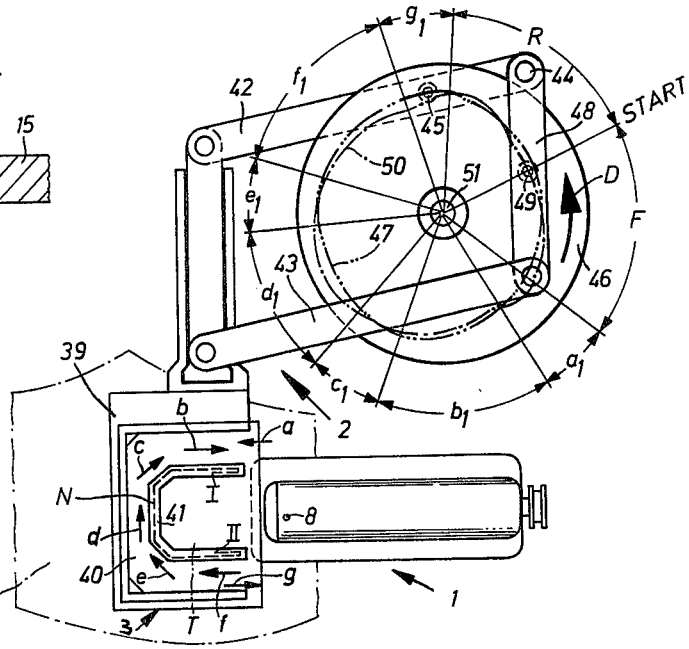
Fig. 3
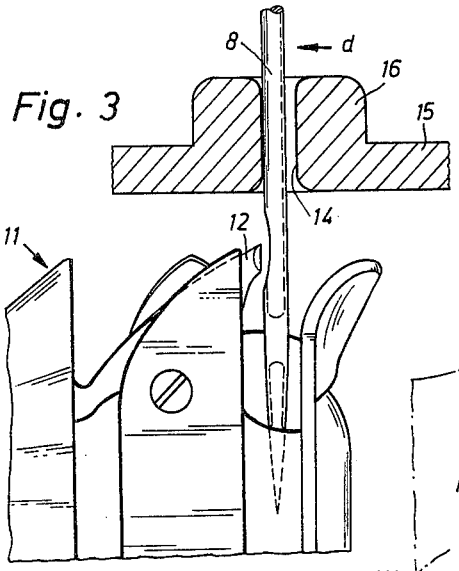

SEWING DEVICE FOR PRODUCING FORM SEAMS

FIELD AND BACKGROUND OF THE INVENTION

This invention relates in general to the construction of sewing machines and, in particular, to a new and useful sewing device for producing form seams which includes a guide device for the needle which is provided with a force-away surface which is movable in a direction opposite to the movement of the workpiece in respect to the needle.

DESCRIPTION OF THE PRIOR ART

The present invention relates to a sewing device for producing form seams, including a guide mechanism for guiding the workpiece along a path corresponding to the desired configuration of the seam and relative to the needle of a sewing machine which cooperates with a rotary hook. The guide mechanism comprises a vertically movable support by which the workpiece is supported in the piercing area of the needle and the support is provided with a stitch hole for the needle.

The term "form seams" refers to seams which may run in different directions, for example, seams for sewing pockets on pieces of clothing, sewing collars and cuffs, ornamental seams on top parts of shoes, etc.

In a sewing device of this kind, for example, as seen from German Offenlegungsschrift No. 2,251,929, it is known to provide a workpiece support which is similar to the feed dog support and is provided with a cylindrical extension corresponding to the width of the slot for the needle passage in the workpiece holder. Vertical oscillating motions are imparted to this holding element, in order to provide an exact support for the workpiece held in the workpiece holder of the guide mechanism during the period of time in which the needle is engaged in the material, and thus to prevent the so-called wave formation caused by the attack of the needle as it penetrates into the workpiece in the abscence of a support.

Since during the production of form seams, the direction of displacement of the workpiece changes several times in the course of one sewing operation, and since in such sewing devices it was necessary, for various reasons, to dispense with an intermittent displacement of the workpiece, the result of the continuous displacement and change of direction of the sewn material, is that the needle, particularly while working with densely woven firm cloth, is bent or deflected by the material in different directions. In order to avoid defective stitches, the needle and the point of the rotary hook, in their loop-engaging position, must be spaced from each other as little as possible without coming into contact with each other since this would damage the point of the hook and make the hook useless in a very short time. However, this is exactly what occurs if the workpiece is displaced in the direction of the rotary hook and, at the same time, the needle is bent toward the hook.

SUMMARY OF THE INVENTION

The purpose of the present invention is to prevent damaging of the rotary hook. More particularly, the invention is directed to a design which prevents the needle from moving into the circular path of the hook point during the displacement of the workpiece in the direction of the rotary hook.

In accordance with the invention, the limiting surface of the stitch hole is associated with the needle as a guide or force-away surface and is made displaceable, in tune with the stitch formation, in an opposite direction relative to the motion of the workpiece toward the rotary hook.

The exchange of the workpiece support and the timing of the displacement of the needle guide surface are facilitated by designing the workpiece support as an anvil plate which is secured to a supporting bar of the sewing machine, and by providing adjustment means for adjusting the magnitude of the displacement which is connected to the bar.

Accordingly, it is an object of the invention to provide a sewing device for producing form seams which are usable with a sewing machine having a needle which reciprocates in respect to a cooperating rotary hook and which also includes a guide mechanism for guiding the workpiece along a path corresponding to the configuration of the form seam in respect to the needle, and which comprises a workpiece support member having a stitch hole for the passage of a needle and which includes a raised surface forming a force-away surface bounding the stitch hole and wherein the workpiece support member is mounted between the needle and the rotary hook by mounting means which are connected to actuating means so as to move the force-away surface in a direction away from the movement of the workpiece during the reciprocation of the needle.

A further object of the invention is to provide a sewing device for producing form seams which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

In the Drawing:

FIG. 1 is a partial top plan view of a sewing machine with a workpiece clamping mechanism usable with the sewing device constructed in accordance with the invention;

FIG. 2 is an enlarged perspective view of a portion of the sewing machine in a simplified representation which includes a workpiece clamping mechanism and guide mechanism associated therewith; and FIG. 3 is an enlarged partial sectional view of a workpiece support constructed in accordance with the invention.

DESCRIPTION OF THE PREFERRED EMBODIMENT

Referring to the drawing in particular, the invention embodied therein, comprises a sewing device which is used on a flat-bed, single-needle sewing machine 1 of conventional construction, which is mounted on a frame, not shown, and driven by a stop motor, also not shown, in a well known manner. Sewing machine 1 is associated with a guide mechanism 2 (FIG. 1) for a workpiece clamping mechanism 3. The free end of a main shaft 4 of the sewing machine, (FIG. 2), carries a main shaft crank 5 which is connected, through a link 6 and an intermediate member 7, to a needle bar 9 carrying a thread guiding needle 8 which is guided for up and down motion in a frame 10. Thread guiding needle 8 cooperates with a lock stitch rotary hook 11 of well-known design having a hook point 12. Rotary hook 11 is secured to a hook shaft 13 rotating at a speed double that of the main shaft 4. To engage hook point 12 into the needle thread loop, needle 8 plunges into a stitch hole 14 of a workpiece support 15 which is designed as a plate and provided with an anvil-like cylindrical extension 16. The loop-engaging position of the stitch-forming parts is shown in FIG. 3.

Workpiece support 15 is secured to a supporting bar 17 of sewing machine 1, the free end 18 of which is forked and engages over an eccentric 19 which is secured to a shaft 20. The free end of supporting bar 17 is hinged, by means of a pin 23, to a crank 22 which is secured to an oscillating shaft 21. With shaft 20 in rotary motion, an oscillatory motion in a vertical plane, about pin 23, is imparted by eccentric 19 to supporting bar 17 and workpiece support 15.

Oscillating shaft 21 is hinged, through a lever 24, a pin 25 and a link 26 to a mechanism for adjusting the magnitude of the horizontal motion in order to also impart a horizontally reciprocating motion to supporting arm 17. On its other end, link 26 is engaged on a pin 27 to which a further link 28 is secured and the free end of which is acted upon by an eccentric bar 29 which engages over a drive eccentric 31 secured to a shaft 30. Link 28 is connected to lever 33, which is secured to an adjusting shaft 36, by means of a pin 32. Shaft 36 is mounted for rotation in a bearing bracket 34 of the fabric supporting plate of sewing machine 1 and can be fixed by means of screws 35. A hand lever 37 is secured to the free end of adjusting shaft 36 by means of a screw 38. Links 26 and 28 have effective lengths which are equal to each other.

As seen in FIG. 1, the workpiece clamping mechanism 3 which receives the workpieces (hind part of trousers W and pocket cut T), comprises a support plate 39 which is displaceable on the fabric supporting plate 15 of sewing machine 1. A clamping plate 40 is pivotally mounted on the supporting plate 39. Both supporting plate 39 and clamping plate 40 are provided with a slot 41, corresponding to the configuration of the seam to be produced. In the example shown, a substantially U-shaped pocket seam N defines a passageway for needle 8. It is to be noted that the diameter of the cylindrical extension 16 of workpiece support 15 is slightly smaller than the width of slot 41 so that, in the piercing area of needle 8, extension 16 can support the workpiece.

Supporting plate 39 of the workpiece clamping mechanism 3 is connected to two links 42, 43 of a parallelogram guide of guide mechanism 2. Link 42 is pivoted to a fixed pin 44 and carries a guide roller 45 projecting into a guide groove 47 which is provided in the underside of a control disc 46 and which, for clarity, is shown as a curved endless dash-dotted line in FIG. 1. Second link 43 is hinged to an intermediate member 48 which is also pivoted to pin 44. Intermediate member 48 carries a guide roller 49 which projects into a guide groove 50 which is provided in the upper side of control disc 46 and is shown curved endless dash-double dot line in FIG. 1. By the rotary motion of control disc 46 about a fixed pivot 51 through 360° divided into portions of travel indicated by F, $a_1$ – $g_1$ and R, produced by a separate motor (not shown), the two links 42 and 43 are pivoted about pin 44 and impart a corresponding motion composed of two components and following the pattern of the seam to be produced to workpiece clamping mechanism 3.

As soon as workpieces W and T are clamped in mechanism 3 with the control disc 46 in rotary motion about its pivot 51 through the portion of travel indicated by F in the direction of arrow D, workpiece clamping mechanism 3 is first displaced from its feed position, according to FIG. 1, to the stitch-forming area in a manner such that point I, at which seam N starts, becomes vertically aligned with the needle, whereupon, sewing machine 1 is started. Due to the guidance of the rollers 45 and 49 in guide grooves 47 and 50 respectively, the workpiece is first displaced in the direction of arrow *a*, for securing the seam while the disc 46 is rotated through portion $a_1$, and then the clamp 3 is continuously moved, while changing its direction several times, as indicated by arrows *b* to *g* of FIG. 1, up to the finish end at II, following a path corresponding to the seam N which has been provided while the disc 46 is rotated through the portions of travel indicated by $b_1$ – $g_1$. At the end of the seam N at II, the sewing machine is stopped, the thread is cut by a known thread cutter and the disc 46 is rotated to its initial or starting position through the portion of travel indicated by R, moving the clamp 3 to its feed position, shown in FIG. 1.

During the run of sewing machine 1, due to eccentric 19, vertical oscillatory motions about pin 23 are imparted to workpiece support 15. These motions are coordinated with the up and down movements of needle 8 in a manner such that the anvil-like extension 16 projecting into slot 41 of plates 39, 40 supports the portion of the workpiece which is presented above the stitch hole 14 during the penetration of needle 8.

Due to the continuous motion of the workpiece during the displacement of the workpiece in the direction of arrows *c*, *d*, and *e*, needle 8 is pressed by the fabric in the direction of rotary hook 11. Horizontal motions are also imparted to the workpiece support 15 in order to displace the limiting surface of stitch hole 14 which serves as a guide or forceaway surface for needle 8. The surface 16 bounding stitch hole 14 is moved in a direction opposite to the motion of the workpiece toward the rotary hook 11 and thus prevents the needle from moving into the circular path of, and colliding with, the hook point 12. The horizontal motions of workpiece support 15 are produced so that through eccentric bar 29 and pin 27, drive eccentric 31 imparts oscillatory motions about pins 25 and 32 to links 26 and 28. These motions are pure rotary motions as long as pins 25 and 32 are aligned. If, upon loosening screws 35, the angular position of adjusting shaft 36 is changed, this shaft, while turning, takes along lever 33 and thus changes the position of pin 32, serving as an axis of rotation for link 28, relative to pin 25. Therefore, while pin 27 is swung out by eccentric bar 29, it executes a pure rotary motion about pin 32, while link 26, aside from this rotary motion, in addition executes a relative motion about shaft 21. This relative motion is transmitted by lever 24 as an oscillatory motion to crank 22 which imparts horizontal motions to workpiece support 15 through supporting bar 17. Adjusting shaft 36 is secured in its adjusted position by tightening screws 35.

It is evident that due to the composed movement of workpiece support 15, the workpiece clamped between plates 39 and 40 is supported during the penetration of needle 8 by the cylindrical extension 16 in the area of penetration of the needle, and that the needle is forced away by the limiting surface of stitch hole 14 in the opposite direction relative to the workpiece displacement (arrow *d*) which is directed toward rotary hook 11.

The movements of the workpiece clamping mechanism 3 in the directions designated *a* to *g*, in relation to guide rollers 45, 49 and to control disk 46, are such that with a complete revolution of control disk 46, all the partial movements of mechanism 3 in the directions indicated *a* to *g* in FIG. 1 are produced, which movements are rectilinear. For transmitting these straight-lined partial movements from guide grooves 47, 50 of control disk 46 through guide rollers 45, 49 to mechanism 3, always both guide grooves 47, 40 must participate in the control. Thus, for producing the partial movements *a, b, f,* and *g*, horizontal in FIG. 1, groove 50 will produce, through roller 49, the main component of the motion, but groove 47 will add, through roller 45, an equalizing motion, since, due to the mounting of the parallelogram linkage 2 supporting mechanism 3 on pivot pin 44, all rectilinear movements are produced by two components of the rotary motion about pin 44. As to partial movement *d*, on the contrary, the main motion component is produced by groove 47 through roller 45, while the equalizing motion for the rotation about pin 44 is furnished by groove 50 through roller 49.

In the obliquely directed partial movements *c* and *e*, both grooves 47 and 50 participate approximately to the same extent.

As shown in FIG. 1, groove 47, in which roller 45 is guided, is indicated as a dash-dotted line, and groove 50, in which roller 49 is guided, is indicated by dash-double dotted line following the actual shape of the groove necessary for producing the movements of mechanism 3. Further, F indicates the angular portion for moving mechanism 3 from its feed position into its sewing-start position. $a_1$ to $g_1$ indicate the corresponding annular portions for producing the partial movements *a* to *g*, and R indicates the angular portion for returning mechanism 3 into its initial position upon finishing the seam.

While producing form seams, the workpiece is moved continuously, even though the direction of the movement is varied several times. This means that the motion of the fabric or the clamping mechanism is not interrupted during the periods in which the needle is engaged in the fabric. Thereby, if thicker and firmly woven material is sewn, the needle is temporarily deflected in the direction of the fabric motion. A deflection of the needle in directions, straight or obliquely, away from the circular path of the hook point has no disadvantageous consequences. If, however, the needle is deflected by the motion of the fabric in a straight or oblique direction toward the path of the hook point, thus in the direction of arrows *c, d,* and *e* of FIG. 1, there is a risk that, in spite of the provisions of the non-designated recess in needle 8, the needle will collide with the hook point and cause damage to the quite expensive rotary hook. The purpose of the boundary surface of the stitch hole is to counteract this deflection of the needle in the direction of the path of motion of the hook point, caused by the moving fabric. The effect is that the needle is not deflected from its normal position and is rather backed by the mentioned boundary surface of the stitch hole or displaced in a direction opposite to the fabric motion, in a manner such that the needle keeps its normal position during a displacement of the fabric toward the hook point or is pushed into its normal position, as shown in FIG. 3.

A force-away motion of some tenths of a millimeter is quite satisfactory for effectively preventing a deflection or bending of the needle by the workpiece and for securely maintaining the needle out of the circular path of the hook point during the displacement of the workpiece toward the hook.

While a specific embodiment of the invention has been shown and described in detail to illustrate the application of the principles of the invention, it will be understood that the invention may be embodied otherwise without departing from such principles.

What is claimed is:

1. A sewing device for producing form seams usable with a sewing machine having a needle which reciprocates in respect to a cooperating rotary hook and which includes a guide mechanism for guiding a workpiece along a path corresponding to the configuration of the form seam with respect to the needle, comprising a workpiece support member having a stitch hole for the passage of the needle and having a force-away surface bounding the stitch hole, mounting means supporting said workpiece support for oscillatory back and forth movement and vertical movement between said needle and said hook, and actuating means connected to said mounting means to move said support member in timed relationship to the reciprocation of said needle and the movement of the workpiece and in a direction opposite to the movement of the workpiece with respect to the needle.

2. A sewing device for producing form seams, according to claim 1, wherein said workpiece support member comprises an anvil plate, said mounting means including a supporting bar connected to said plate, said actuating means including means for adjusting the magnitude of displacement of said anvil plate.

3. A sewing device for producing form seams, according to claim 1, wherein said workpiece support member comprises a plate, a supporting bar connected to said plate having a forked end, a rotatable shaft having an eccentric thereon operating in timed relationship to the operation of said needle, said eccentric being located between the forked end of said supporting bar and effecting the upward and downward movement of this end of said supporting bar, a crank connected to the opposite end of said bar for pivoting said bar for vertical movement of being shiftable to move said bar horizontally backwardly and forwardly during the operation of said needle.

4. A sewing device for producing form seams, according to claim 3, wherein said actuating means includes a mechanism connected to said lever for shifting said crank backwardly and forwardly and means associated with said actuating means for varying the magnitude of shifting of said lever during the reciprocation of said needle.

* * * * *